United States Patent [19]

Teague

[11] Patent Number: 4,907,489

[45] Date of Patent: Mar. 13, 1990

[54] BLANK FIRE CONFIGURATION FOR AUTOMATIC PISTOL

[75] Inventor: Tommy L. Teague, Albuquerque, N. Mex.

[73] Assignee: The United States of America as represented by the United States Department of Energy, Washington, D.C.

[21] Appl. No.: 238,450

[22] Filed: Aug. 31, 1988

[51] Int. Cl.[4] ..... F41C 21/22; F41F 17/12

[52] U.S. Cl. ..... 89/14.5; 89/196

[58] Field of Search ..... 89/14.5, 196, 128, 163

[56] References Cited

U.S. PATENT DOCUMENTS

| | | | |
|---|---|---|---|
| 2,090,657 | 8/1937 | Williams | 89/196 |
| 2,127,973 | 8/1938 | Walther | 42/3 |
| 2,356,538 | 8/1944 | Schmeisser | 42/1 |
| 3,137,204 | 6/1964 | Harvey | 89/14 |
| 3,363,509 | 1/1968 | Tschoepe | 89/14 |
| 3,435,727 | 4/1969 | Pachmayr et al. | 89/196 |
| 3,440,924 | 4/1969 | Sawyer | 89/14 |
| 3,657,959 | 4/1972 | Kart | 89/128 |
| 3,744,370 | 7/1973 | Snodgrass | 89/145 |
| 4,222,308 | 9/1980 | Arnett | 89/163 |
| 4,261,246 | 4/1981 | Skahill | 89/145 |
| 4,499,811 | 2/1985 | Kaste | 89/14.5 |
| 4,580,484 | 4/1986 | Moore | 89/128 |

OTHER PUBLICATIONS

"Tactical Training For Security Personnel", *Sandia Technology,* Sand 81-1813, vol. 5, No. 7, Dec. 1981, pp. 16-27.

"Hollywood Heat In Miami, New Hardware Muscles In On The Action", Soldier of Fortune, vol. 11, No. 10, Oct. 1986, pp. 40-43.

*Primary Examiner*—David H. Brown

*Attorney, Agent, or Firm*—Anne D. Daniel; James H. Chafin; William R. Moser

[57] ABSTRACT

A pistol configured to fire blank cartridges includes a modified barrel with a breech portion connected to an aligned inner sleeve. Around the inner sleeve, there is disposed an outer sleeve having a vent therein through which the cartridge discharges. The breech portion is connected to a barrel anchor to move backward in a slight arc when the pistol is fired. A spring retention rod projects from the barrel anchor and receives a shortened recoil spring therearound which recoil spring has one end abutting a stop on the barrel anchor and the other end in abutment with the end of a spring retaining cup. The spring retaining cup is engaged by a flange projecting from a slide so that when the pistol is fired, the slide moves rearwardly against the compression of the spring to eject the spent cartridge and then moves forwardly under the urging of the spring to load a fresh cartridge into the breech portion. The spring then returns all of the slidable elements to their initial position so that the pistol may again be fired.

6 Claims, 3 Drawing Sheets

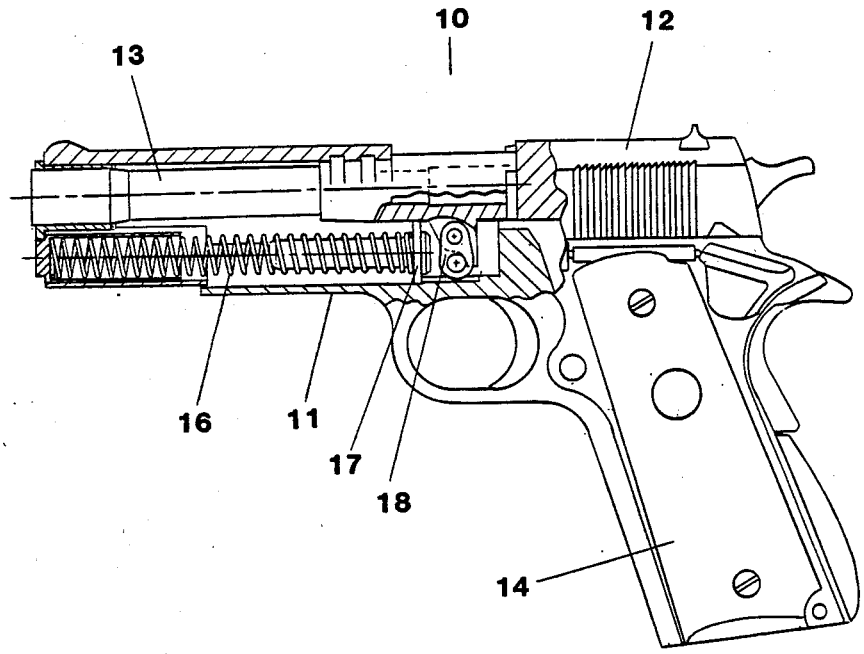
FIG. 1 - PRIOR ART
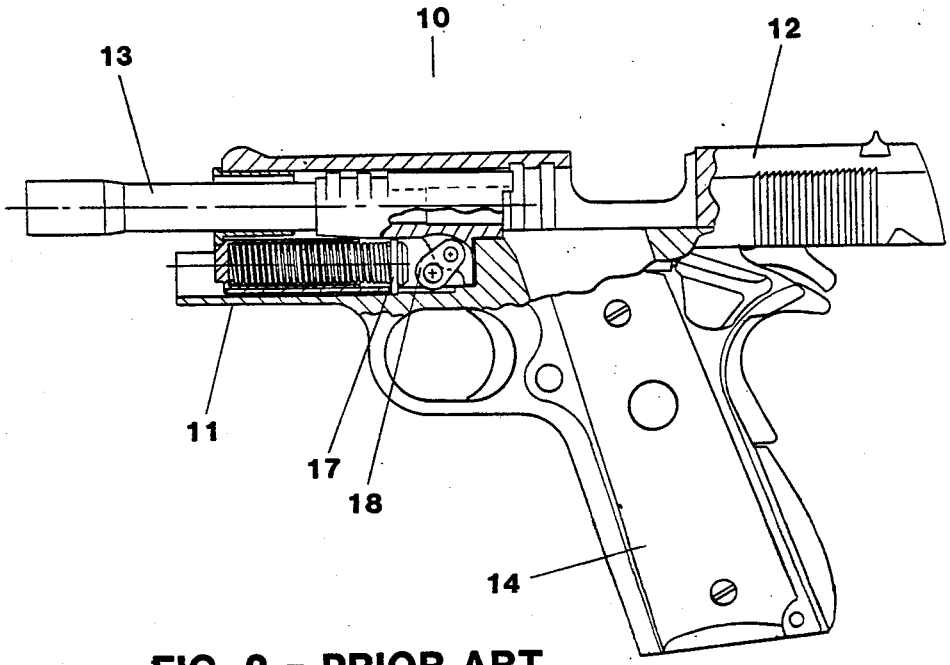
FIG. 2 - PRIOR ART

BLANK FIRE CONFIGURATION FOR AUTOMATIC PISTOL

The United States Government has rights in this invention pursuant to Contract DE-AC04-76DP00789 between the United States Department of Energy and AT&T Technologies, Inc.

BACKGROUND OF THE INVENTION

The instant invention relates to blank fire configurations for automatic pistols. More particularly the instant invention relates to converting a standard automatic pistol to a configuration where the pistol fires blanks in order to simulate live fire for practice and theatrical uses.

Automatic reloading fire arms generally use either gas operated systems or recoil operated systems. Gas operated systems use the pressure of expanding gases produced from burning propellant to operate the reloading mechanism, whereas recoil operated systems use force generated by the recoil of a barrel and/or spent cartridge in relation to the bullet being accelerated from the barrel to operate the reloading mechanism. In either case, the reloading mechanism can be operated by firing blanks after attaching a properly sized restrictor orifice to the muzzle end of the barrel. By doing this, gas pressure is allowed to build up in the barrel and thus drive the reloading mechanism.

Many automatic pistols, including the Colt family of pistols, use a recoil operated system in which the barrel and slide are locked together. The recoil, which results when the bullet is fired, forces the barrel and slide to move as a unit until the barrel unlocks from the slide and stops in the proper position for reloading. The slide continues moving, extracting the spent cartridge and loading a new cartridge into the barrel as it returns to its original position. Firing a blank cartridge in the Colt-type of automatic pistol produces no motion of the barrel and slide due to the fact that firing a blank cartridge produces no recoil. If one attaches a restrictor orifice to the muzzle, pressure builds up in the barrel, but no motion occurs because the barrel and slide are locked together and cannot move independently. Without recoil, the barrel and slide do not unlock.

In order to make the pistol operate with blank fire, one can remove the locking features from the barrel and attach a restrictor orifice to the muzzle. The barrel then remains stationary and the slide is forced rearwardly as gas pressure pushes the spent cartridge from the rear of the barrel. Since the barrel does not move, it is not in proper reloading position. Consequently, the pistol often fails to load the next cartridge, which causes the pistol to jam.

In another approach, the barrel may be modified so that the slide will move a short distance and then contact the barrel and force it rearwardly to the reloading position. However, the amount of gas pressure necessary to operate this type of system is so great that burning gun powder is expelled rearwardly from the barrel when the spent cartridge is extracted. The burning gun powder can strike the shooter in the face, consequently this approach is not acceptable because it is unsafe.

The patent literature contains a number of blank firing attachments, however, these are all systems utilized with automatic rifles or machine guns so as to provide realistic training for troops. The following U.S. patents are exemplary of these approaches: U.S. Pat. Nos. 3,440,924; 4,499,811; 3,137,204; 3,744,370; and 4,261,246. The patent literature also includes kits for modifying automatic pistols for various purposes. For example, U.S. Pat. No. 3,657,959 converts a pistol to fire smaller caliber ammunition, while U.S. Pat. No. 4,580,484 discloses an arrangement for converting a recoil operated automatic pistol to a gas operated automatic pistol. The patent literature does not include references directed to solving the particular problem of converting an automatic pistol which is standard issue to a blank firing pistol for training purposes and theatrical purposes.

SUMMARY OF THE INVENTION

It is an object of the instant invention to provide a new and improved blank fire configuration for recoil operated automatic pistols wherein a standard live fire pistol can be quickly converted to a safe blank firing pistol for training and theatrical purposes.

Upon further study of the specification and appended claims, further objects and advantages of this invention will become apparent to those skilled in the art.

In view of this object, and other objects, the instant invention contemplates a recoil operated automatic pistol which has been modified to fire blank cartridges by removing the live fire barrel and replacing the live fire barrel with a short barrel to which an inner sleeve is threaded so as to act as a unit with the barrel. An outer sleeve having a restrictor orifice at its muzzle end receives the inner sleeve therein and is restrained from forward motion by a barrel anchor secured to the pistol frame by a pin. The barrel anchor also secures the barrel in the frame, but allows the barrel to reciprocate with respect to the frame in a manner similar to reciprocation of the barrel of an unmodified live firing pistol. A cushion is removably attached to the barrel anchor which is attached to the pistol frame in the path of a portion of the slide so as to limit rearward movement of the slide and to absorb the impact therefrom. Extending from the barrel anchor in spaced relation to the barrel is a rod around which the recoil spring is positioned. The rod projects through an opening in a flange on the slide, which flange abuts the recoil spring so as to stabilize the barrel anchor.

In operation, the blank firing pistol functions as follows. When a blank cartridge is fired, the expanding gases create pressure between the modified barrel and outer sleeve. Since the outer sleeve is restrained from forward motion by the barrel anchor, the pressure forces the barrel and slide to move rearwardly. As the barrel moves rearwardly, it unlocks from the slide and stops in the proper position for reloading. The pressure still inside the barrel forces the spent cartridge from the barrel, causing the slide to continue its rearward motion until it contacts the cushion. The spent cartridge is ejected and a new cartridge is stripped from the magazine and loaded into the barrel as the slide moves forward under the pressure of the recoil spring. The amount of pressure in the barrel is controlled by the size of the restrictor orifice in the outer sleeve. A properly sized orifice will allow operation of the system without an excess of pressure which might result in a rearward ejection of burning gun powder when the spent cartridge is extacted. In accordance with a preferred embodiment of the invention, the outer sleeve discharges the gas through a downwardly facing orifice so as to avoid injury to any one standing in front of the gun.

This is important because in training exercises for police officers and security personnel, blank guns are frequently fired at close range.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein:

FIG. 1 is a side elevation of a live fire pistol of the type to be modified in accordance with the principles of the instant invention, shown prior to its modification and prior to firing the pistol;

FIG. 2 is a view of the pistol of FIG. 1, subsequent to firing the pistol;

DESCRIPTION OF THE PREFERRED EMBODIMENTS

Figure 3:
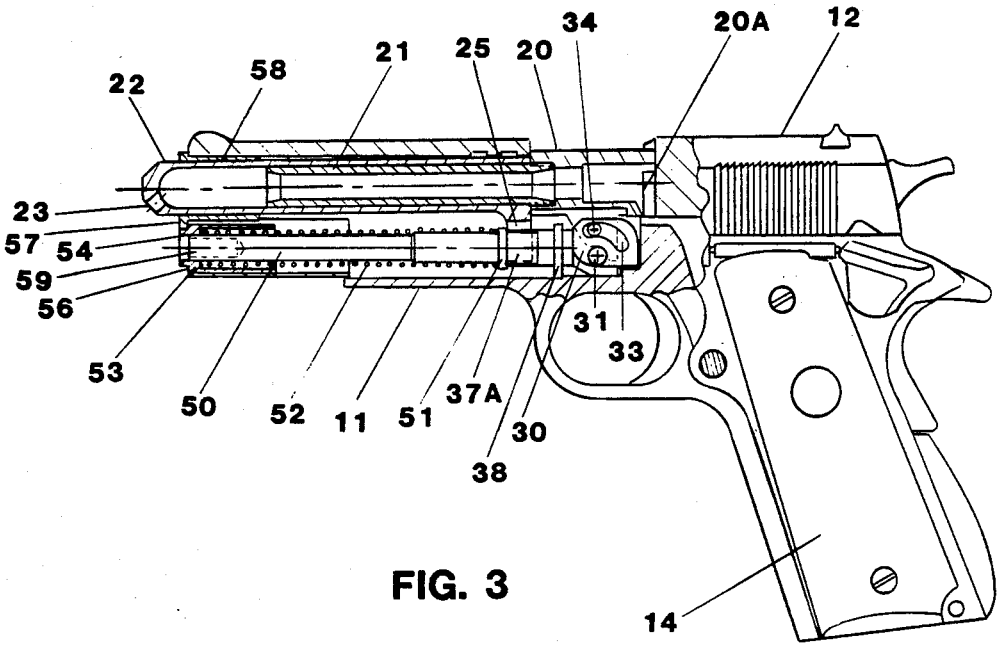
FIG. 3 is a side elevation of the pistol, such as the pistol of FIG. 1, after it has been modified to a blank fire configuration in accordance with the principles of the instant invention and prior to firing the pistol.

Referring first to FIGS. 1 and 2, there is shown a pistol, designated generally by the numeral 10, in the form of a Colt Mark IV configured for firing live ammunition. The pistol 10 basically comprises a frame 11, a slide 12 which reciprocates on the frame 11 and a barrel 13 through which bullets are fired as they are fed from a magazine (not shown) in the handle 14 of the pistol. When the pistol is fired, the recoil action of the bullet forces the slide 12 rearwardly against the bias of a recoil spring 16 mounted on a spring guide 17. A link 18 moves from the FIG. 1 position to the FIG. 2 position to limit rearward movement of the barrel 13 and cock the hammer. The spent shell is ejected from the barrel 13 as the slide 12 moves rearwardly and as the slide 12 moves again in the forward direction it engages and pushes a new cartridge into the firing chamber of the barrel 13.

Figure 4:
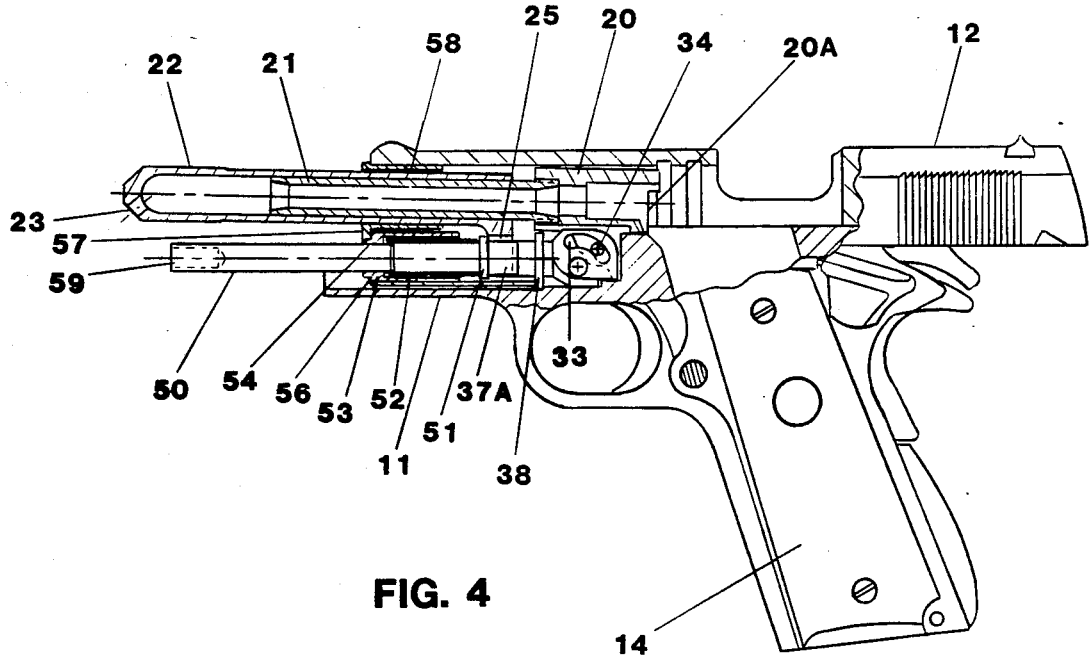
FIG. 4 is a view of the pistol of FIG. 3, showing the configuration of the modified pistol after it has been fired.
Figure 5A:
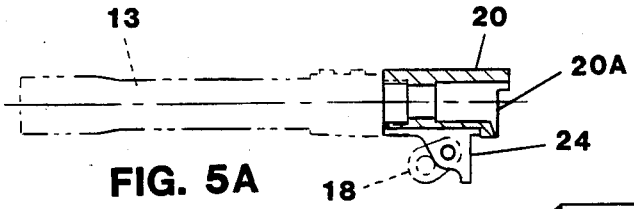
FIGS. 5A, 5B, and 5C are side elevation, front and bottom views, respectively, of the barrel modified in accordance with the principles of the instant invention.
Figure 6:
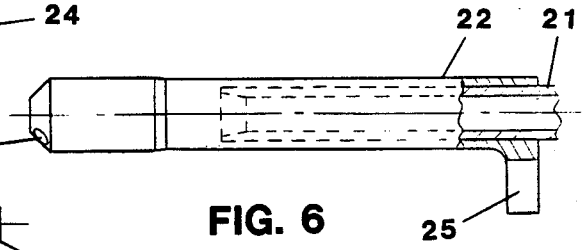
FIG. 6 is a side elevation of an inner sleeve which is threadably secured to the modified barrel of FIG. 5 and an outer sleeve which receives the inner sleeve.
Figure 5B:
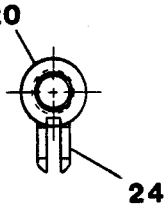
Figure 5C:
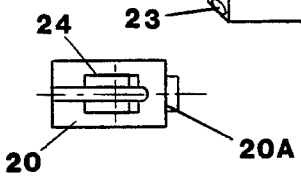

In order to convert the live fire pistol shown in FIGS. 1 and 2 to the blank firing pistol shown in FIGS. 3 and 4, the barrel 13 is replaced with a modified barrel 20, configured as shown in FIGS. 5A–5C, having a breech portion 20A. Link 18 of FIGS. 1 and 2 is deleted from modified barrel 20. The replaced barrel 13 and deleted link 18, respectively, are shown as dotted line portions of FIG. 5A. The modified barrel 20 is relatively short and has a threaded end into which an inner sleeve 21 (see FIG. 6) is screwed. The inner sleeve 21 has a constant inner diameter all the way through with the exception of a slightly flared end. As is seen in FIG. 6, the inner sleeve is slidably received in an outer sleeve 22 having a downwardly opening vent 23.

Figure 7A:
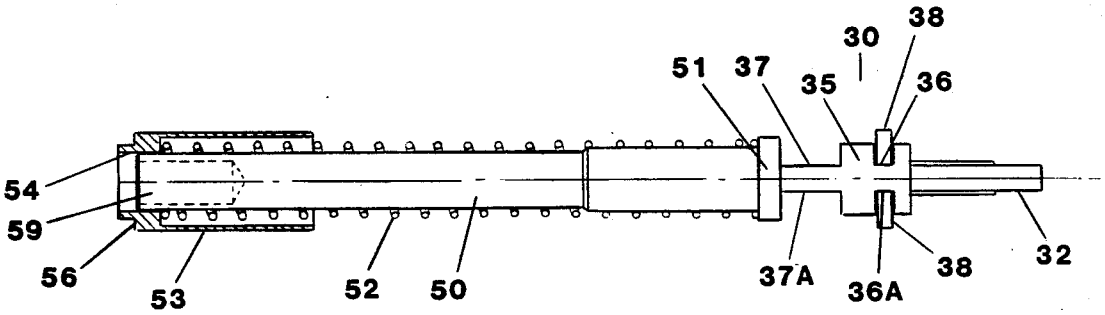
FIGS. 7A, 7B, and 7C are top, side and rear views, respectively, of a barrel anchor and rod combination of the invention.
Figure 7B:
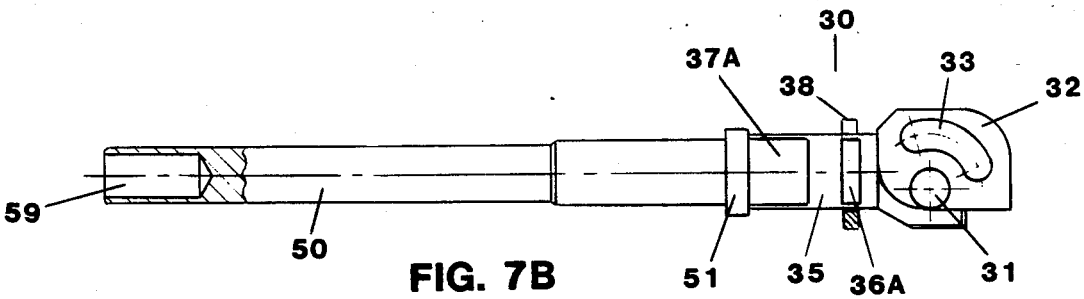
Figure 7C:
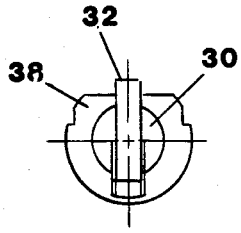
Figure 7D:
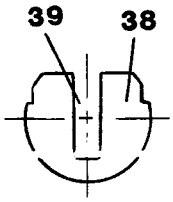
FIG. 7D is a front view of the cushion of the invention, which may be positioned on the barrel anchor, as shown in FIGS. 7A, 7B, and 7C.

The three elements, comprising the modified barrel 20 and breech portion 20A, the inner sleeve 21 and the outer sleeve 22, comprise a modified barrel assembly which is attached to the frame 11 of the pistol 10 via a barrel anchor 30 (see FIGS. 7A–7C). The barrel anchor 30 is secured by a pin 31 to the frame 11 and has a flange 32 thereon with an arcuate slot 33 therein. The slot 33 receives a pin 34 which is also received in the projecting yoke 24 of the modified barrel 20. The barrel anchor 30 has a retaining portion 35 defined by a first pair of opposed grooves 36 and 36A onto which the cushion 38, having a slot 39, is fitted. When the barrel anchor 30 is mounted in the frame 11 of the pistol 10, the cushion 38 stops rearward motion of the slide 12 when a blank is fired. The outer sleeve 22 is stabilized by a slotted ear 25 which projects downwardly therefrom and is received in a second pair of opposed grooves 37 and 37A on the barrel anchor 30. Opposed grooves 37 and 37A prevent forward motion of the outer sleeve 22, when slotted ear 25 is engaged in grooves 37 and 37A.

As is seen in FIG. 7A, a spring retention rod 50 projects from the barrel anchor 30 and projects forwardly with respect to the pistol frame 11 (FIGS. 3 and 4) while a shortened recoil spring 52 surrounds the rod 50. Spring 52 has an inboard end abutting a stop 51 on the barrel anchor 30 and an outboard end seated in a spring cup 53 which has a bore 54 therethrough. Rod 50 passes through the bore 54. Spring cup 53 has a shoulder 56 thereon which is engaged by a projecting flange 57 extending from a bearing 58 seated in the slide 12 of the pistol 10. When the slide 12 moves backward upon firing the pistol 10, the flange 57 pulls the cup 53 back against the bias of spring 52 so as to compress the spring 52. The rod 50 may include a bore 59 in the end thereof for receiving a laser training device, if desired.

As is seen when one compares FIGS. 3 and 4, the rear end of the inner sleeve 21 and the modified barrel 20 tilt down slightly due to the pin 34 riding in the slot 33. This positions the breech 20A of modified barrel 20 to receive a blank cartridge as the slide 12 moves from the FIG. 4 to the FIG. 3 position under the bias of rcoil spring 52. Upon firing a subsequent blank cartridge, the cycle is repeated with the slide 12 moving rearwardly, the inner sleeve 21 moving back slightly within and in respect to the outer sleeve 22 while tilting down slightly to receive a subsequent blank cartridge.

Figure 8:
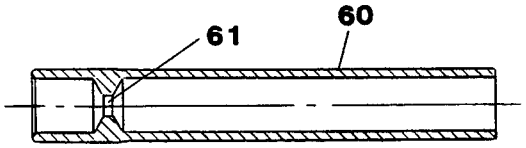
FIG. 8 is a view of the outer sleeve for a forward venting blank firing pistol in accordance with the principles of the instant invention.

Referring now to FIG. 8, there is shown an outer sleeve barrel 60 which is configured for forward venting of a blank firing pistol. The forward venting barrel 60 has a constriction 61 therein disposed slightly inboard of the end of the barrel. This embodiment of the invention is especially useful for theatrical performances wherein smoke emerges axially from the end of the pistol 10 instead of being deflected downwardly as is the case with the outer sleeve 22 (FIG. 6).

The aforedescribed arrangement, in a specific embodiment, is designed to convert a Colt MK IV 9 mm automatic pistol to operate with blank ammunition. However, the principles employed could be used to convert other Colt automatic pistols and other makes of pistols to blank firing systems as long as the pistols generally utilize the same operating mechanisms.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An automatic pistol operable to fire blank ammunition wherein said pistol includes a frame, a slide mounted on said frame for reciprocal movement between a first position and a second position, wherein when said slide is in the first position, said pistol can fire, moving said slide to the second position, allowing a spent cartridge to be ejected as said slide moves toward the second position and a live cartridge to be positioned for firing as said slide moves back toward the first position, said pistol comprising:

(a) a modified barrel including a breech and an inner hollow sleeve rigidly attached to and extending from said breech;

(b) an outer sleeve having a diameter greater than said inner sleeve and having a constricted orifice therein, said outer sleeve telescopically receiving said inner sleeve;

(c) barrel anchor means connected to said frame of said pistol, said barrel anchor means including means for connecting said breech of said modified barrel to said barrel anchor means and means for restraining motion of said breech to arcuate motion with respect to said barrel anchor means and means for restraining forward motion of said outer sleeve with respect to said barrel anchor means;

(d) rod means projecting from said barrel anchor means in a direction substantially parallel to the direction of said sleeves when said slide is in the first position;

(e) a shortened recoil spring received over said rod means, said spring having an inboard end abutting a stop on said barrel anchor means and an outboard end abutted by spring retaining means connected to said slide, whereby when said pistol is fired, said slide moves toward the second position against the bias of said spring to eject the spent cartridge from said breech while said breech moves slightly backward in an arc to receive a fresh cartridge and said outer sleeve remains horizontally stationary with respect to said frame, said spring restoring said slide, said breech, and said inner sleeve to their original positions upon pushing said slide to its first position.

2. The pistol of claim 1, wherein said orifice in said outer sleeve is located at an end of said outer sleeve and faces downwardly.

3. The pistol of claim 1, wherein said outer sleeve has an open end and a constriction therein wherein the discharge from a cartridge is axially aligned with said outer sleeve.

4. The pistol of claim 1, wherein said means for connecting said breech and said barrel anchor means comprises an arcuate slot in a flange on said barrel anchor means which receives a pin extending through a bore on said breech.

5. The pistol of claim 1, further including a cushion rigidly mounted on said barrel anchor means against which said slide impacts when said pistol fires to transmit recoil thereof to said frame.

6. The pistol of claim 1, wherein said spring retaining means includes a cup which fits over said spring, said cup having a bore at an end thereof through which bore said rod means extends, said spring retaining means extending from said slide and engaging said cup in order to compress said spring.

* * * * *